United States Patent [19]

Abe

[11] Patent Number: 4,825,829

[45] Date of Patent: May 2, 1989

[54] IDLE SPEED CONTROL SYSTEM FOR AN AUTOMOTIVE ENGINE

[75] Inventor: Kunihiro Abe, Higashimurayama, Japan

[73] Assignee: Fuji Jokogyo Kabushiki Kaisha, Tokyo, Japan

[21] Appl. No.: 179,506

[22] Filed: Apr. 8, 1988

[30] Foreign Application Priority Data

Apr. 13, 1987 [JP] Japan ..... 62-091524

[51] Int. Cl.[4] ..... F02M 3/12; F02D 41/16

[52] U.S. Cl. ..... 123/339; 123/587; 123/588

[58] Field of Search ..... 123/339, 340, 352, 585, 123/587, 588

[56] References Cited

U.S. PATENT DOCUMENTS

| | | | |
|---|---|---|---|
| 4,474,151 | 10/1984 | Atago et al. | 123/339 |
| 4,479,471 | 10/1984 | Hasegawa et al. | 123/339 |
| 4,498,436 | 2/1985 | Horiuchi | 123/339 |
| 4,513,710 | 4/1985 | Kobayashi et al. | 123/339 |
| 4,519,089 | 5/1985 | Hara et al. | 123/339 X |
| 4,522,176 | 6/1985 | Takao et al. | 123/339 |
| 4,526,144 | 7/1985 | Hasegawa et al. | 123/339 |
| 4,651,694 | 3/1987 | Kataoka | 123/339 |
| 4,716,871 | 1/1988 | Sakamoto et al. | 123/339 |
| 4,747,379 | 5/1988 | Oba | 123/339 |

FOREIGN PATENT DOCUMENTS

| | | |
|---|---|---|
| 58-183841 | 10/1983 | Japan . |
| 59-3135 | 1/1984 | Japan . |

*Primary Examiner*—Willis R. Wolfe
*Attorney, Agent, or Firm*—Martin A. Farber

[57] ABSTRACT

A cold-engine operation detector is provided for producing a cold-engine signal when engine temperature is lower than a predetermined temperature, and an idle engine speed detector is provided. A dead zone for input of engine speed with respect to desired engine speed in accordance with engine temperature is stored in a memory. Width of the dead zone is provided to increase with decrease of engine temperature. A range of the dead zone in accordance with engine temperature is derived from the memory. When actual engine speed is out of a derived range of the dead zone, an actuator provided in an idle speed control system is operated for controlling the actual engine speed to the desired engine speed.

3 Claims, 4 Drawing Sheets

IDLE SPEED CONTROL SYSTEM FOR AN AUTOMOTIVE ENGINE

BACKGROUND OF THE INVENTION

The present invention relates to a system for controlling idle speed of an automotive engine having an electronic fuel-injection system, and more particularly to a control system for the fast idle at cold-engine operation.

In an idle speed control system for an electronic fuel injection system, a bypass having an idle speed control valve is provided around a throttle valve of the engine. The idle speed control valve is operated to control the amount of intake air for maintaining a desired idle speed by a feedback control system. The desired idle speed is derived from a memory based on input signals representing engine operating conditions. Namely, the opening degree of the idle speed control valve is controlled in accordance with various engine driving conditions such as starting of the engine, fast idle at cold-engine operation, and transient state.

When the engine is cold, the response speed of the engine is slow. Accordingly, if the opening degree of the idle speed control valve is increased to increase the amount of fuel so as to control the idle speed to the desired idle speed, the engine speed does not increase immediately. Thus, if the feedback control continues, hunting of the system may occur.

Hence, in general, under such driving conditions, the engine speed is controlled by the open-loop control to restrict the hunting. However, if the engine speed reduces at cold-engine operation, the reduced engine speed is not recovered, which causes the engine to stall.

On the other hand, Japanese Patent Application Laid-Open 59-3135 discloses a feedback control system for controlling the idle speed control valve at cold-engine operation. In the system, integral term in a feedback value is reduced so that the engine speed slowly approaches the desired engine speed, thereby preventing the stall of the system. However, even if the effect of the feedback control is delayed, the hunting can not be prevented.

SUMMARY OF THE INVENTION

The object of the present invention is to provide an idle speed control system which may effectively control the engine speed in accordance with the variation of the response characteristics of the engine with increase of temperature of the engine, thereby preventing the hunting of the system.

According to the present invention, there is provided a system for controlling idle speed of an automotive engine having a fuel injection system comprising, a throttle position sensor for producing an idle signal when a throttle valve of the engine is closed, a neutral state detector responsive to the idle signal for producing a neutral signal when a transmission of a motor vehicle is in a neutral state, an engine temperature detector responsive to the neutral signal for producing a temperature signal dependent on temperature of the engine, cold-engine operation detector means for producing a cold-engine signal when the engine temperature is lower than a predetermined temperature, and an engine speed detector for producing an engine speed signal dependent on speed of the engine.

The system has a first memory storing desired engine speeds in accordance with engine temperature, a second memory storing dead zone for input of engine speed with respect to the desired engine speed in accordance with engine temperature, width of the dead zone being provided to increase with decrease of the engine temperature, first deriving means responsive to the cold-engine signal for deriving a desired engine speed from the first memory in accordance with the temperature signal, second deriving means for deriving a range of the dead zone in accordance with the temperature signal, comparator means for comparing actual engine speed dependent on the engine speed signal with a derived desired engine speed and for producing a comparator signal when the actual engine speed does not coincide with the desired engine speed, determining means responsive to the comparator signal for producing an actuating signal when the actual engine speed is out of a derived range of the dead zone, driving means responsive to the actuating means for actuating an actuator provided in the idle speed control system for controlling the actual engine speed to the derived desired engine speed.

In an aspect of the invention, the determining means determines whether the actual engine speed is higher or lower than an upper limit value or lower limit value of the dead zone, and the actuator is a solenoid operated valve provided in a bypass around the throttle valve.

The other objects and features of this invention will be apparently understood from the following description with reference to the accompanying drawings.

DETAILED DESCRIPTION OF THE PREFERRED EMBODIMENT

Figure 1:
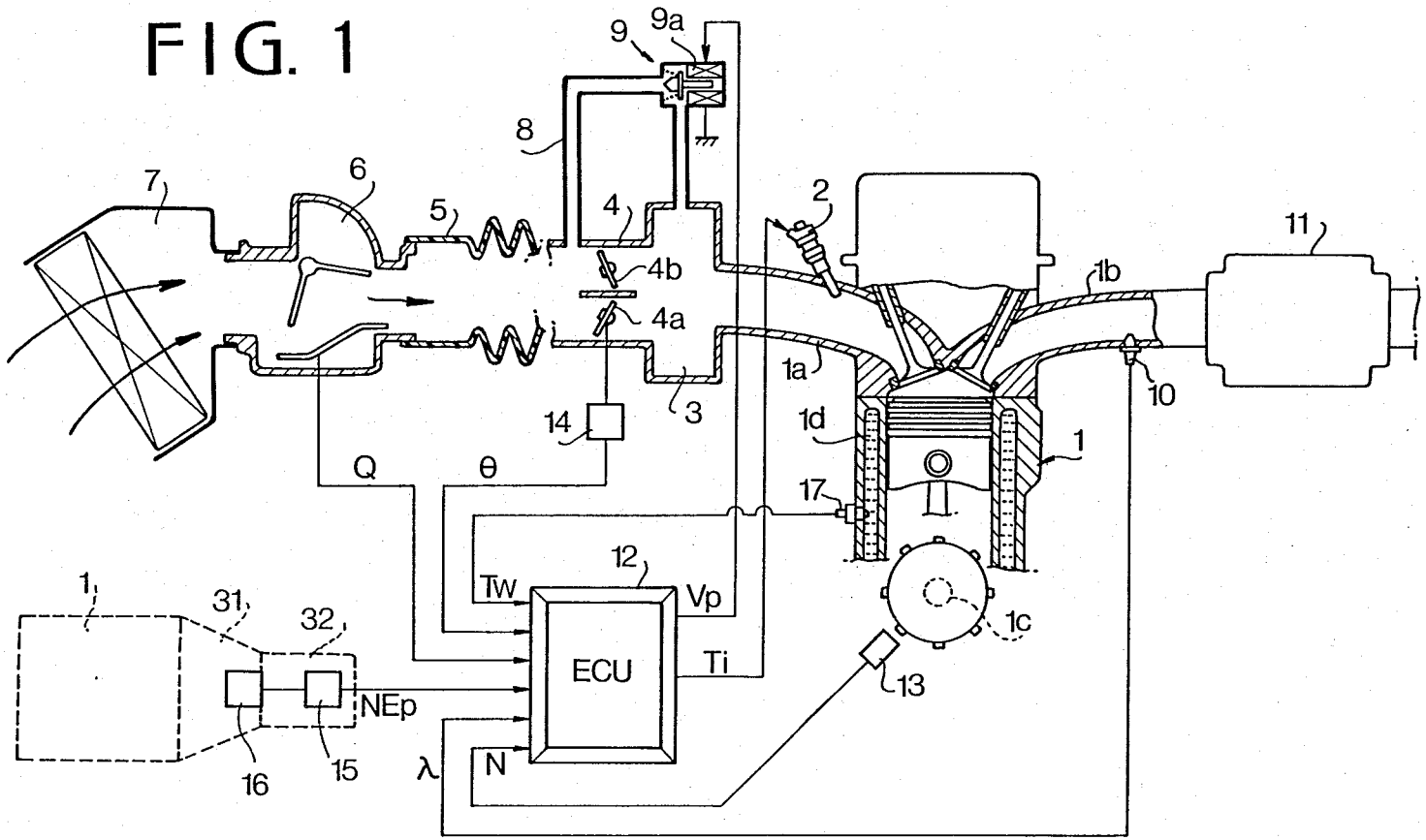
FIG. 1 is a schematic illustration showing a system of the present invention.

Referring to FIG. 1, in an intake manifold 1*a* of an engine 1, a fuel injector 2 is provided for supplying fuel to each cylinder of the engine 1. A surge tank 3 is provided downstream of a throttle body 4 which is communicated with an air cleaner 7 through an intake passage 5 and a mass air flow meter 6. In the throttle body 4, a primary throttle valve 4*a* and a secondary throttle valve 4*b* are provided. A solenoid operated idle speed control valve 9 is provided in a bypass 8 around the throttle valves 4*a* and 4*b*, and actuated by a solenoid 9*a* An $O_2$ sensor 10 and a catalytic converter 11 are provided in an exhaust manifold 1*b*.

A throttle position sensor 14 is provided for detecting the opening degree of the primary throttle valve 4*a*. Output signals from the air flow meter 6, $O_2$ sensor 10, and throttle position sensor 14 are applied to an electronic control unit (ECU) 12. A crank angle sensor 13 is provided adjacent a crankshaft 1*c* of the engine 1 for detecting an engine speed. A coolant temperature sensor 17 is provided on a water jacket 1*d* of the engine 1. Output signals of these sensors 13 and 17 are supplied to the control unit 12. The control unit 12 is also applied with an output signal from a transmission state detector comprising a transmission switch 15 and a clutch switch 16 which are connected in series to form an AND circuit. When a transmission 32 is at a neutral state and a clutch 31 of the transmission 32 is engaged, these switches 15 and 16 are turned on to produce a neutral/-clutch signal NEP. In response to the input signals, the control unit 12 produces actuating signals to operate the injector 2 and a solenoid 9a of the idle speed control valve 9.

Figure 2:
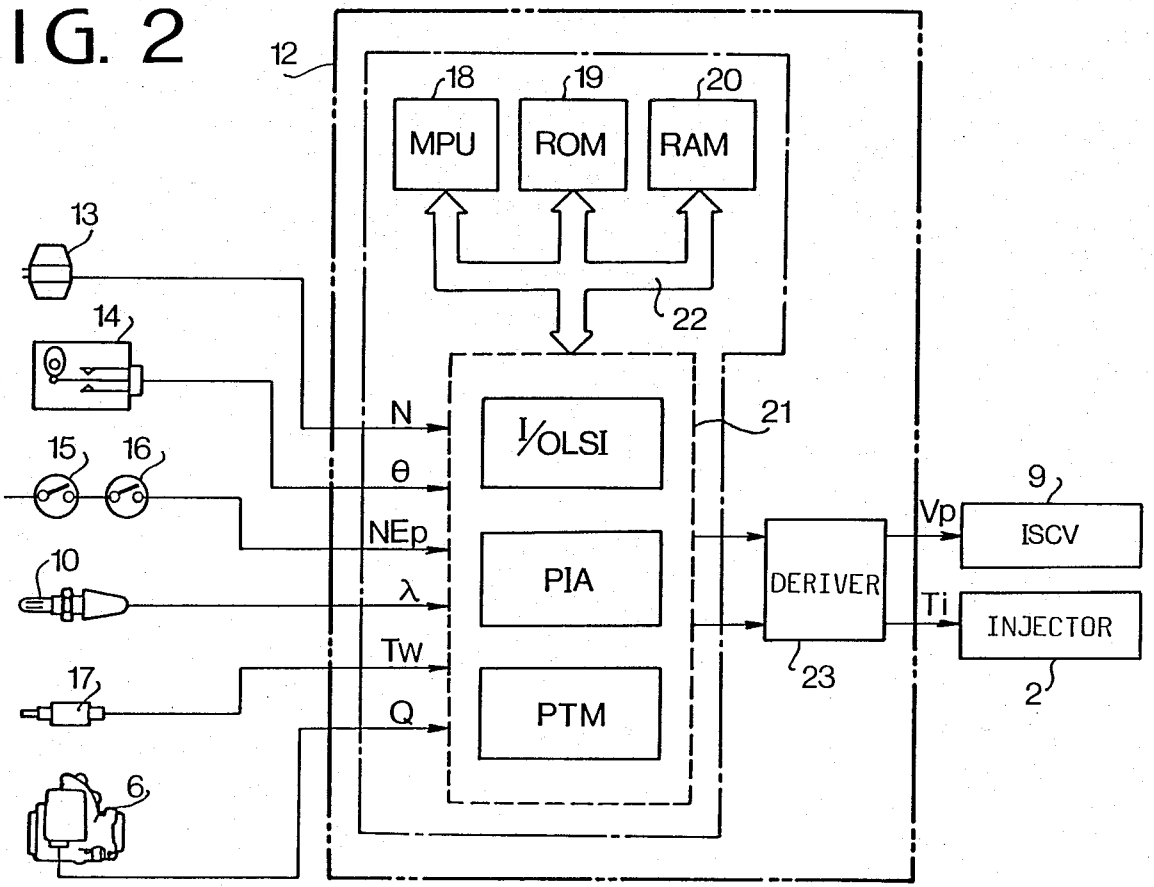
FIG. 2 is a block diagram of a control unit used in a system of the present invention.

Referring to FIG. 2, the electronic control unit 12 comprises a microprocessing unit (MPU) 18, a read only memory (ROM) 19, a random access memory (RAM) 20, and an input/output control unit 21 having an I/O LSI, PIA (peripheral interface adapter) and PTM (programmable timer module). The MPU 18, ROM 19, RAM 20 and unit 21 are connected to each other through a bus line 22. The input/output control unit 21 is applied with the engine speed signal Ne from the crank angle sensor 3, the throttle position signal $\theta$ from the throttle position sensor 14, the neutral/clutch signal NEp from the AND circuit comprising the transmission switch 15 and the clutch switch 5 16, the feedback control signal $\lambda$ from the $O_2$ sensor 10, the coolant temperature signal Tw from the coolant temperature sensor 17, and the intake air quantity signal Q from the air flow meter 6. These signals are stored in the RAM 20. In the MPU 18, a desired fuel injection pulse width and a valve opening degree of the idle speed control valve 9 are calculated based on the stored data in the RAM 20 and data and programs stored in the ROM 19. A driver 23 produces pulses Ti and Vp for actuating the injector 2 and the idle speed control valve 9 in response to output signals of the input/output control unit 21. The control valve 9 is opened and closed by the pulses Vp and flow rate of air passing the valve increases with increase of duty cycle of the pulses.

Figure 4:
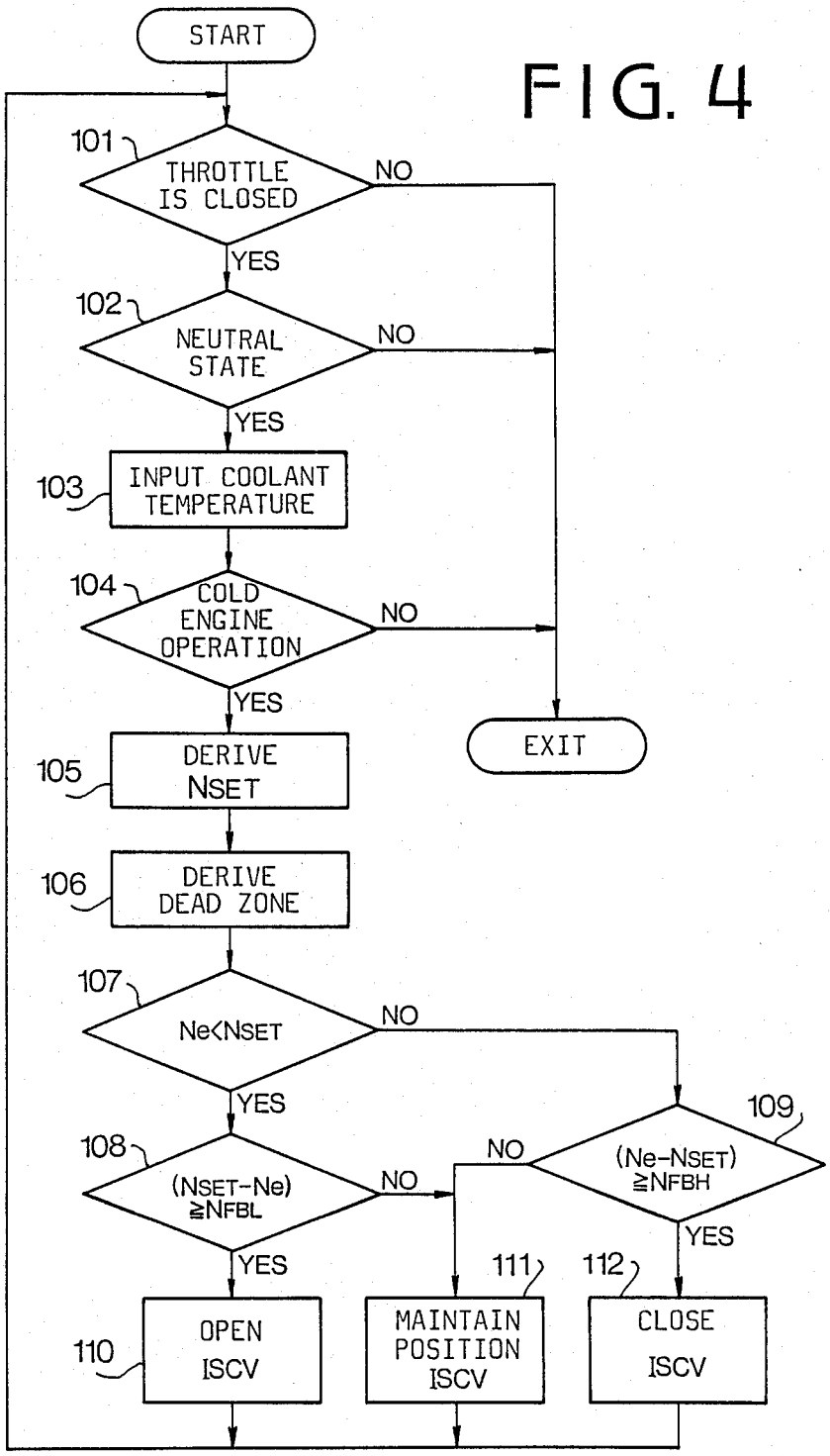
FIG. 4 is a flowchart showing the operation of the system of the present invention.

The operation will be described hereinafter with reference to the flow chart of FIG. 4.

At a step 101, it is determined whether the throttle valve 4a is closed or not in accordance with the throttle position signal $\theta$. When the throttle valve 4a is closed, an idling state is determined, and the program proceeds to a step 102. When the valve 4a is opened, the program goes to an exit for a normal driving operation of the engine.

At step 102, in accordance with the neutral/clutch signal NEp, the selection of the neutral range and the engagement of the clutch are decided. When the transmission switch 15 is turned on and the clutch switch 16 is turned on, the program proceeds to a step 103.

At step 103, the coolant temperature signal Tw of the coolant temperature sensor 17 is read. At a step 104, the cold-engine operation is determined in accordance with the coolant temperature Tw. When the coolant temperature Tw is lower than or equal to a predetermined temperature To (To is, for example, 70° C.), the cold-engine operation is determined, and the program proceeds to a step 105.

At step 105, a desired idle speed $N_{SET}$ is derived from a table in the ROM 19 in accordance with the coolant temperature. The desired idle speeds dependent on the temperature of the engine are obtained by experiments and are stored in the ROM 19.

Figure 3:
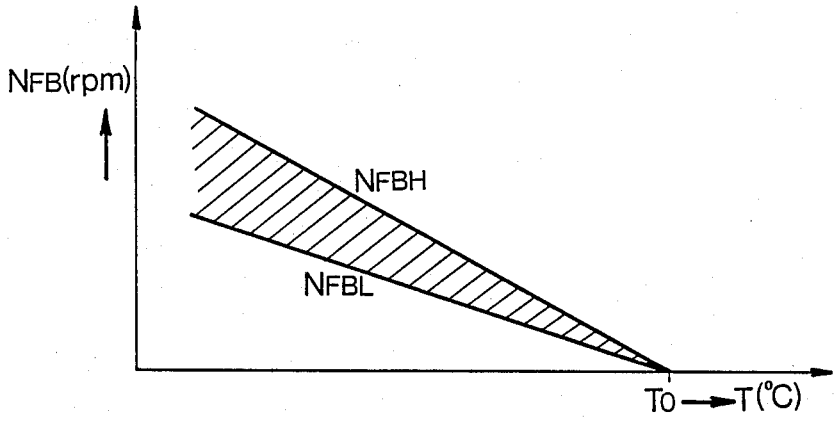
FIG. 3 is a graph showing a dead zone of input engine speed in a feedback control system.

At a step 106, a dead zone $N_{FB}$ of the input engine speed with respect to the desired idle speed is derived from a lookup table stored in the ROM 19 in accordance with the coolant temperature Tw. Response characteristics of the engine with respect to the coolant temperature Tw are obtained by experiments. The dead zone $N_{FB}$ is determined based on the response characteristics of the engine and stored in the ROM 19. As shown in FIG. 3, the width of the dead zone $N_{FB}$ increases as the coolant temperature Tw decreases.

At a step 107, an actual engine speed Ne obtained by the engine speed signal Ne is compared with the desired idle speed $N_{SET}$ obtained at the step 105. When $Ne < N_{SET}$, the program proceeds to a step 108. When $Ne \geqq N_{SET}$, the program goes to a step 109.

At step 108, it is determined whether a difference between the desired idle speed $N_{SET}$ and the actual engine speed Ne ($N_{SET} - Ne$) is larger than $N_{FBL}$ at the coolant temperature. When the program proceeds to a step 110. When $(N_{SET} - Ne) < N_{FBL}$, the program proceeds to a step 111.

At step 110, input/output control unit 21 of the control unit 12 actuates the driver 23 to produce the pulse Vp having a larger duty cycle which are supplied to the solenoid 9a of the idle speed control valve 9. Therefore, flow rate of the air passing through the bypass 8 increases. Accordingly, the driver 23 produce the pulse Ti for increasing the amount of injected fuel, which is supplied to the injector 2. Thus, engine speed is increased. Then the program returns to the step 101.

On the other hand, at step 109, it is determined whether a difference between the actual engine speed Ne and the desired engine idle speed $N_{SET}$ ($Ne - N_{SET}$) is larger than $N_{FBH}$ or not. When $(Ne - N_{SET}) \geqq N_{FBH}$, the program proceeds to a step 112. When $(Ne - N_{SET}) < N_{FBH}$, the program proceeds to the step 111.

At step 112, duty cycle of the solenoid 9a of the idle speed control valve 9 is reduced to reduce flow rate of air, so that fuel injected from the injector 2 is reduced. Accordingly, the engine speed is reduced. Thus, the engine speed is controlled within the dead zone $N_{FB}$.

At step 111, since the engine speed is within the dead zone $N_{FB}$, the idle speed control valve 9 maintains the actual position.

In the case of an automatic transmission, the transmission switch 15 and the clutch switch 16 in the described embodiment are substituted with a neutral switch of the automatic transmission. The coolant temperature sensor 17 of the embodiment may be replaced with an exhaust gas temperature sensor.

Although the feedback control operation is determined by comparing the difference between the actual engine speed Ne and the desired engine speed $N_{SET}$ with the width of the dead zone, it is possible to determine it by determining whether the actual engine speed is higher or lower than an upper limit value or a lower limit value of a dead zone.

In accordance with the present invention, since the range of dead zone is changed to be reduced as the coolant temperature increases in accordance with the response characteristic of the engine, the engine idle speed is smoothly controlled without hunting at cold-engine operation.

While the presently preferred embodiment of the present invention has been shown and described, it is to be understood that this disclosure is for the purpose of illustration and that various changes and modifications may be made without departing from scope of the invention as set forth in the appended claims.

What is claimed is:

1. A system for controlling idle speed of an automotive engine having a fuel injection system comprising:

a throttle position sensor for producing an idle signal when a throttle valve of the engine is closed;

a neutral state detector responsive to the idle signal for producing a neutral signal when a transmission of a motor vehicle is in a neutral state;

an engine temperature detector responsive to the neutral signal for producing a temperature signal dependent on temperature of the engine;

cold-engine operation detector means for producing a cold-engine signal when the engine temperature is lower than a predetermined temperature;

an engine speed detector for producing an engine speed signal dependent on speed of the engine;

a first memory storing desired engine speeds in accordance with the engine temperature signal;

a second memory storing dead zone for input of engine speed with respect to th desired engine speed in accordance with engine temperature, width of the dead zone being provided to increase with decrease of the engine temperature;

first deriving means responsive to the cold-engine signal for deriving a desired engine speed from the first memory in accordance with the temperature signal;

second deriving means for deriving a range of the dead zone in accordance with the temperature signal;

comparator means for comparing actual engine speed dependent on the engine speed signal with a derived desired engine speed and for producing a comparator signal when the actual engine speed does not coincide with the desired engine speed;

determining means responsive to the comparator signal for producing an actuating signal when the actual engine speed is out of a derived range of the dead zone;

driving means responsive to the actuating means for actuating an actuator provided in the idle speed control system for controlling the actual engine speed to the derived desired engine speed.

2. The system according to claim 1 wherein the determining means determines whether the actual engine speed is higher or lower than an upper limit value or lower limit value of the dead zone.

3. The system according to claim 1 wherein the actuator is a solenoid operated valve provided in a bypass around the throttle valve.

* * * * *